United States Patent [19]

Orii et al.

[11] Patent Number: 4,702,350

[45] Date of Patent: Oct. 27, 1987

[54] SPRING DRIVE DEVICE

[75] Inventors: Makoto Orii; Katsuhiko Hayashi, both of Nagano, Japan

[73] Assignee: Kabushiki Kaisha Sankyo Seiki Seisakusho, Nagano, Japan

[21] Appl. No.: 870,604

[22] Filed: Jun. 4, 1986

[30] Foreign Application Priority Data

Jun. 5, 1985 [JP] Japan ..... 60-122160

[51] Int. Cl.[4] ..... F03G 1/00

[52] U.S. Cl. ..... 185/39; 185/45; 446/330

[58] Field of Search ..... 185/37, 39, 45; 446/330, 352, 353, 464

[56] References Cited

U.S. PATENT DOCUMENTS

| | | | |
|---|---|---|---|
| 1,930,450 | 10/1933 | Langos | 446/464 |
| 3,377,740 | 4/1968 | Bonanno et al. | 446/330 |
| 3,393,771 | 7/1968 | Lohr et al. | 185/39 X |
| 4,456,805 | 6/1984 | Jorgensen et al. | 185/39 |

*Primary Examiner*—Allan D. Hermann

*Attorney, Agent, or Firm*—Sughrue, Mion, Zinn, Macpeak & Seas

[57] ABSTRACT

A spring drive device in which a spring holder, a rotor and an output gear are all loosely mounted on a shaft. The spring holder is prevented from rotating and holds one end of a coil spring, the other end of which is held by the output gear. The rotor rotates together with the output gear but is limited in the angle through which it can rotate. The coil spring can be wound and thereafter provide motive power to the output gear.

9 Claims, 13 Drawing Figures

SPRING DRIVE DEVICE

BACKGROUND OF THE INVENTION

1. Field of the Invention

This invention relates to a spring drive device with a coil spring as a drive source.

2. Background Art

A variety of spring drive source with coil springs as their drive sources have been proposed and put in practical use. Also, a variety of methods of increasing the torque of these drive sources have been proposed in the art.

In most of the spring drive devices which utilize coil springs as drive sources, one end of the spring is engaged with a stationary member such as a frame. Therefore, the spring drive devices suffer from the difficulty that it is rather difficult to assemble.

SUMMARY OF THE INVENTION

Accordingly, an object of the invention is to provide a spring driven drive source which is easy to assemble.

In a spring drive device according to the invention, a spring holder, an output gear, and a rotor are mounted on the same shaft, and a part of the spring holder is engaged with a stationary member such as a case, in order to facilitate its assembling operation.

The coil spring is locked at one end to the spring holder and at the other end to the output gear. The coil spring is wound and charged to some extent so that the rotor is bias-wound with its range of rotation being regulated in the direction of release of the spring. Under this condition, the winding means is turned until the rotation of the rotor is stopped, in order to wind the coil spring. Upon releasing of the coil spring, the output gear is turned by the wound energy of the coil spring.

DETAILED DESCRIPTION OF THE PREFERRED EMBODIMENTS

One embodiment of the spring drive device of this invention will be described with reference to the accompanying drawings in detail.

Figure 1:
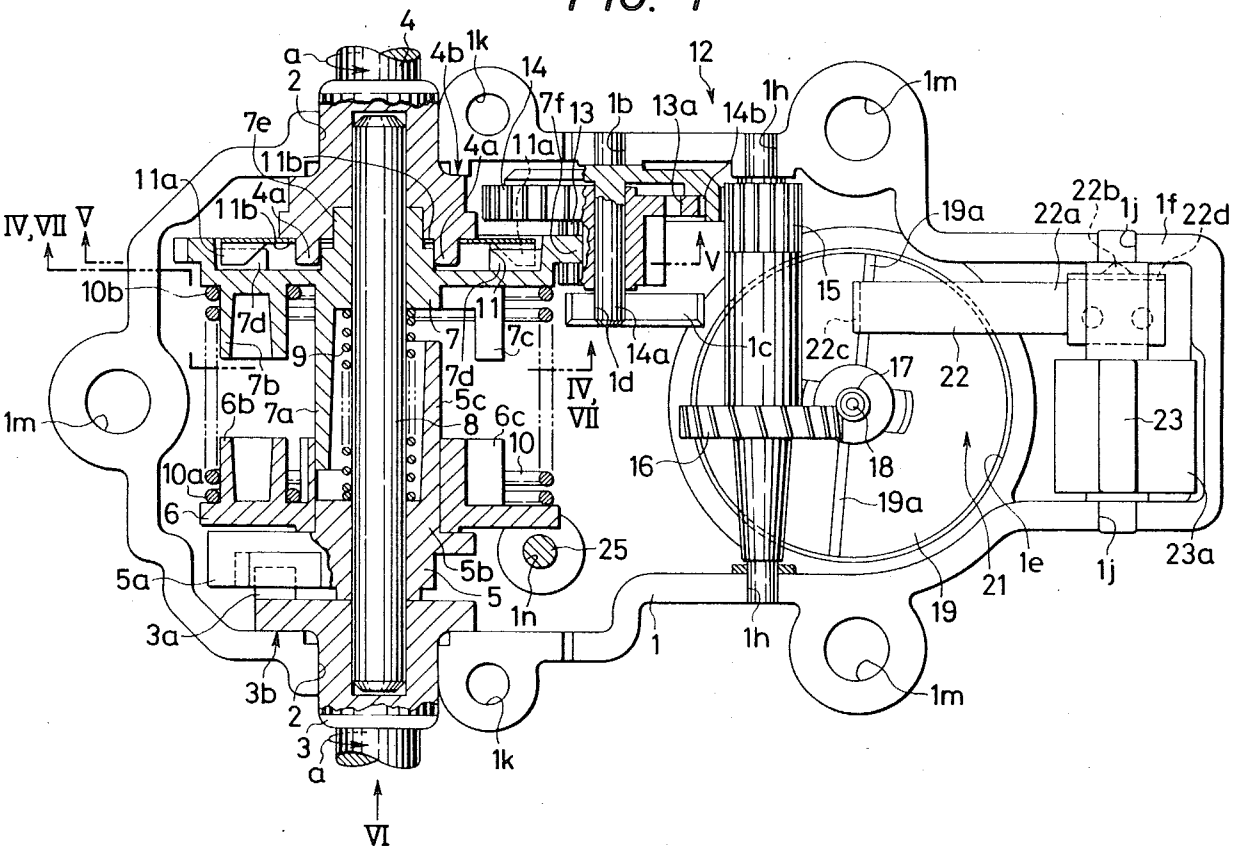
FIG. 1 is an enlarged plan view showing one example of a spring drive device according to this invention.
Figure 2:
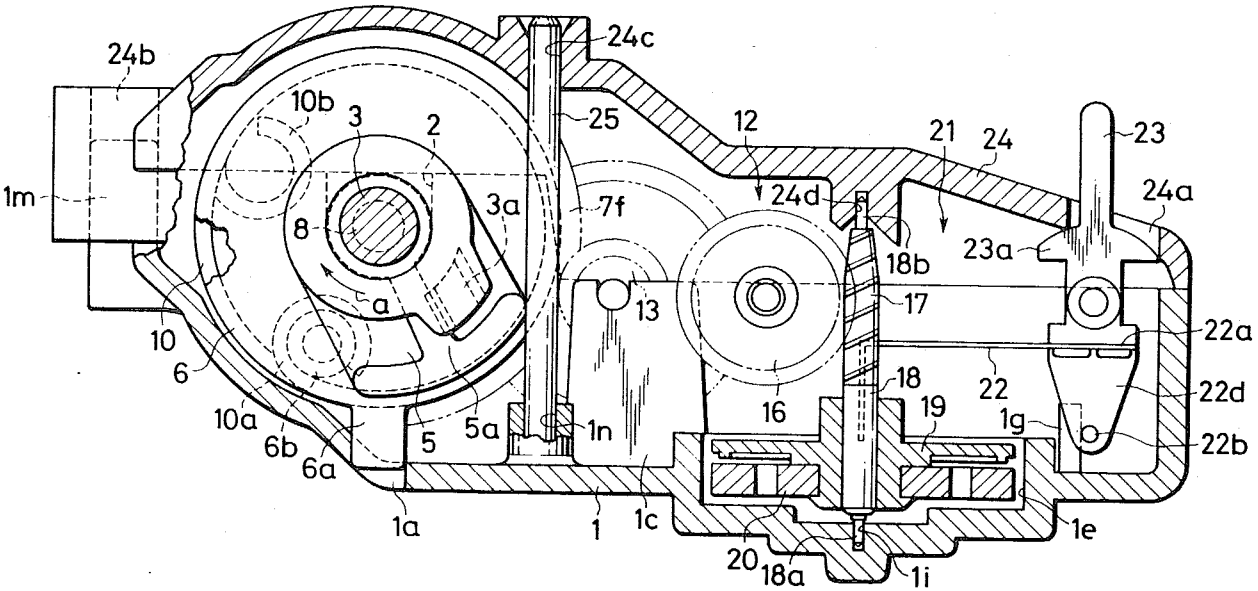
FIG. 2 is a sectional front view of the spring drive device shown in FIG. 1.
Figure 3:
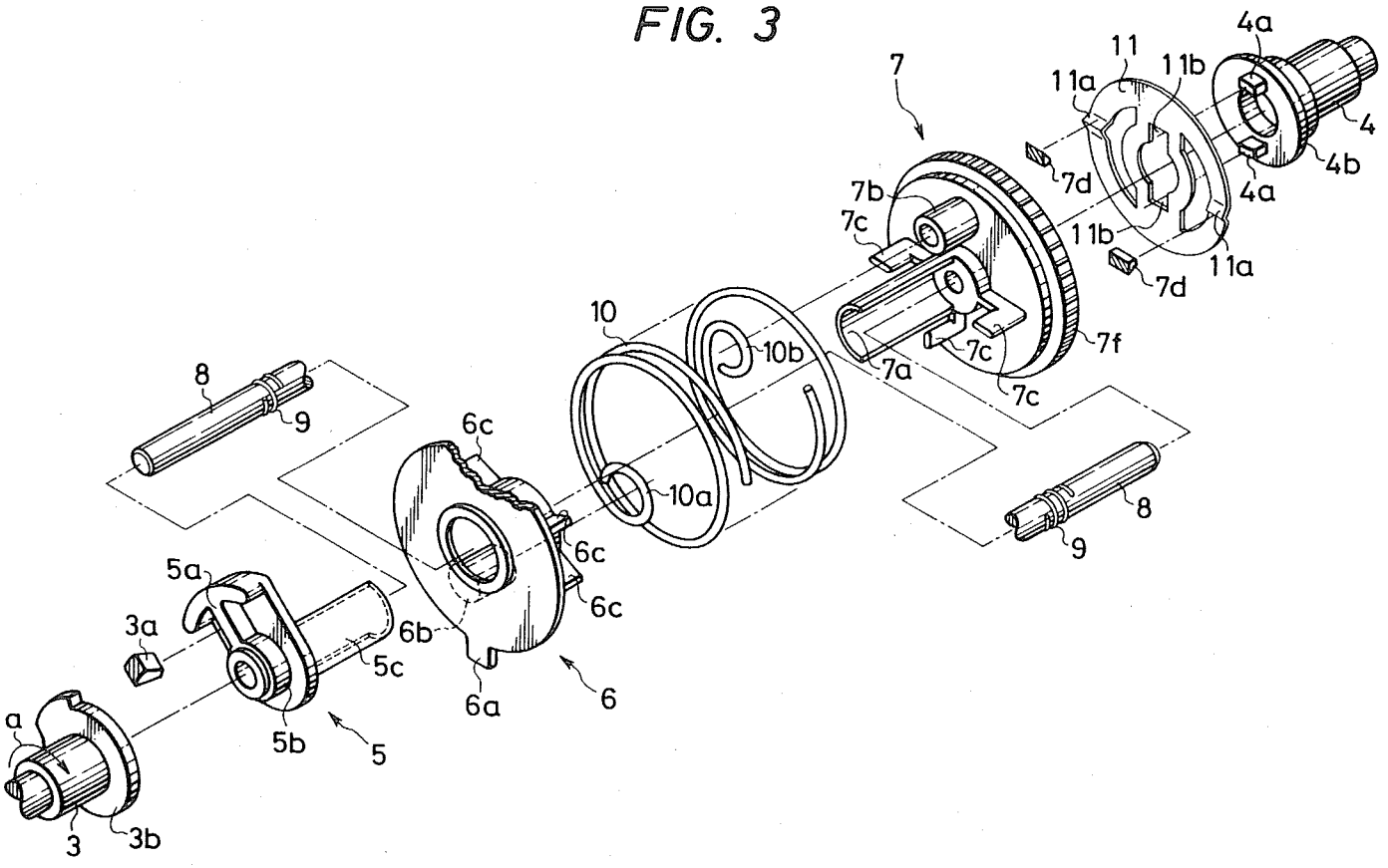
FIG. 3 is an exploded view of essential components of the spring drive device shown in FIG. 1.

In FIGS. 1 through 3, is shown a stationary member, namely, the lower case. The lower case 1 has a pair of bearing grooves 2 into which respective connectors 3 and 4 are rotatably inserted. The connectors 3 and 4 are used to connect the spring drive device to driven devices such as the right and left arms of a doll, thus forming a part of a winding means for winding a coil spring (described later). Accordingly, the parts (not shown) of the connectors 3 and 4 are so shaped that they are most suitable for connecting the device to the driven bodies. On a shaft 8 are mounted a rotor 5, a spring holder 6, an output gear 7, and a compressed central coil spring 9. Both ends of the shaft 8 are inserted and fixed into respective upper and lower connectors 3 and 4. The rotor 5, spring holder 6 and output gear 7 can both loosely rotate on the shaft and be displaced axially.

The lower connector 3 has an inward protrusion 3*a* extending towards the rotor 5. The rotor 5 comprises an engaging part 5*a* adapted to engage with the protrusion 3*a*, a boss 5*b*, and a half-split cylinder 5*c* extending along the shaft 8 from the boss 5*b* towards the output gear 7. The surface of the protrusion 3*a*, which is engaged with the engaging part 5*a*, is slightly sloped from the perpendicular, so that the protrusion 3*a* and the engaging part 5*a* are disengaged from each other at the time of overload. More specifically, the sloped surface is so shaped that its winding side has a steep inclined angle so that the rotor can slide upwards when excessive torque is being transmitted. In other words, it can be said that a torque limiter is provided between the rotor 5 and the connector 3.

The spring holder 6 is fitted on the boss 5*b* of the rotor and has an engaging tab 6*a* protruding from its periphery. The engaging tab 6*a* is engaged with an engaging hole 1*a* (shown only in FIG. 2) formed in the case 1 so that the spring holder 6 is fixedly held. A locking post 6*b* locks one end 10*a* of a coil spring 10, which is a power spring, and guide pieces 6*c* prevent the unwanted deformation of the spring when it is energized. The locking post 6*b* and the guide pieces are formed on one side of the spring holder 6.

Figure 4:
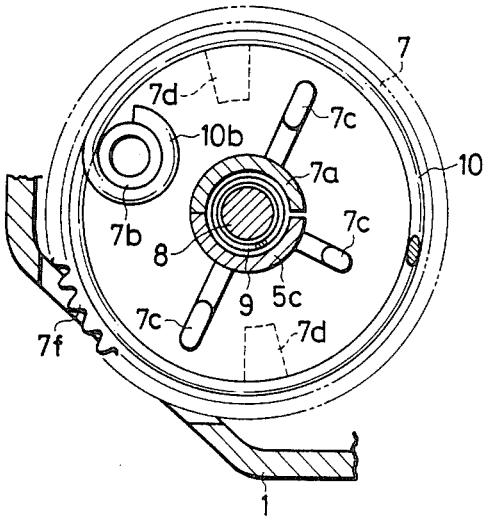
FIG. 4 is a sectional view taken along line IV—IV in FIG. 1.
Figure 7:
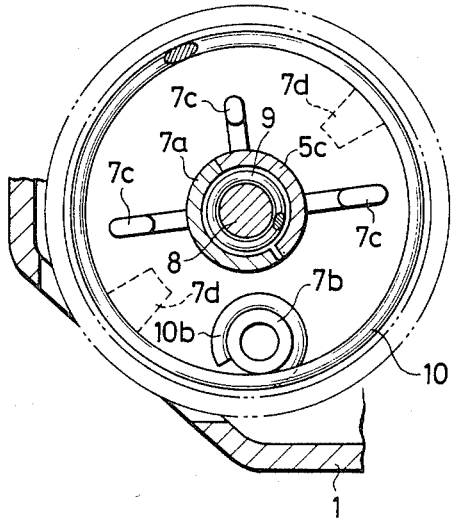
FIG. 7 is a sectional view taken along line VII—VII in FIG. 1.

Similarly, the output gear 7 has on its one side a half-split cylinder 7*a* extending along the shaft B, a locking post 7*b* for locking the other end 10*b* of the coil spring 10, and guide pieces 7*c*, 7*c* and 7*c* for preventing the unwanted deformation of the spring when it is energized. The half-split cylinder 7*a* of the output gear 7, as shown best in FIGS. 4 and 7, is engaged with the half-split cylinder 5*c* of the rotor 5. That is, the rotor 5 and the output gear 7 are coupled to each other on the shaft 8 in the direction of rotation. The output gear 7 has a pair of engaging protrusions 7*d* on the side opposite from the rotor 5. The two engaging protrusions 7*d* are diametrically disposed (at 180° apart). A ratchet 11 made of a leaf spring is fitted on the boss 7*e* of the output gear 7. A pair of bent protrusions 11*a* are formed on the side of the ratchet 11 confronting the output gear 7, in such a manner that the bent protrusions 11a are positioned diameterically apart by 180°. The abutment surfaces of the engaging protrusions 7*d*, which are engaged with the bent protrusions 11*a*, are slightly sloped. The ratchet 11 and the engaging protrusions 7*d* form a torque limiter, so that the ratchet 11 is elastically deformed at the time of overload. The ratchet 11 has cuts 11b, which are engaged with engaging protrusions 4*a*, which are formed on the upper connector 4.

A gear 7*f* of the output gear 7 is engaged with a gear 13 of a speed governor means 12. The governor 12, as shown in FIGS. 1 and 2, includes the gear 13 engaging the output gear 7. A gear 14 is coupled through a ratchet mechanism to the gear 13. A gear 15 is engaged with the gear 14. A worm gear 16 integral with the gear 15. A worm 17 is formed on a worm shaft 18 in such a manner that the worm 17 engages with the worm gear 16. A braking rotor 20 is fixedly secured to the worm shaft 18 through a retaining plate 19. A stopper 21 used to stop the rotation of the worm shaft 18 is partially attached thereto. The gear 13 is rotatably mounted on a shaft 14*a* of the gear 14. The shaft 14*a* is inserted into a bearing groove 1*b* of the lower case 1 and a bearing groove 1*d* of a protruding support 1*c*.

A plurality of arms 13*a* are formed on the gear 13 in such a manner that they tend to open and expand so as to engage with ratchet teeth 14*b* formed on the inner wall of the gear 14. Therefore, the arms 14*a* rotate freely when the spring is being wound, and they rotate together with the gear 14 when the spring is released.

The shaft of the gear 15 and the worm gear 16 is inserted into a pair of opposed bearing grooves 1*h* formed in the lower case 1. The worm shaft 18 has a tenon 18*a* at its lower end, which is inserted into a hole 1*i* formed in the bottom of the lower case 1 and another tenon 18*b* at its upper end, engaging a groove 24*d* of an upper case 24. A train of gears 13 through 17 form a speed increasing gear train. The braking rotor 20 is press-fitted on the receiving stand 19, and has a plurality of arms and attached weights. As the speed of the worm shaft 18 increases, the weights cause the arms to open and expand to slidably contact the cylindrical wall 1*e* of the lower case 1, thereby to brake the gear train, i.e., to brake the output gear 7.

Figure 9:
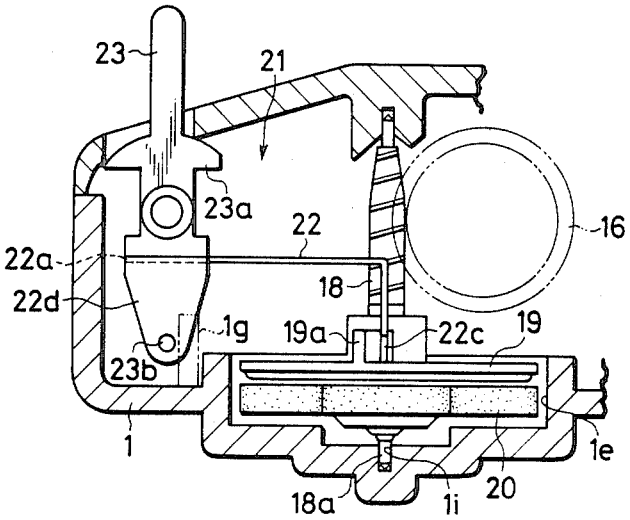
FIG. 9 is a sectional rear view showing essential components of a speed governor.
Figure 10:
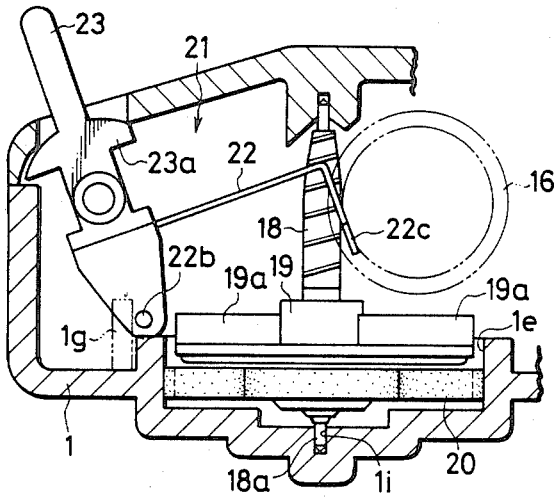
FIG. 10 is a view similar to FIG. 9 showing a stopper hook in a retracted position.
Figure 11:
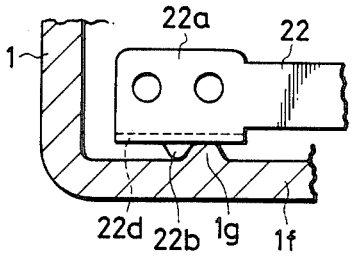
FIG. 11 is a sectional plan view showing other essential components of the speed governor.
Figure 12:
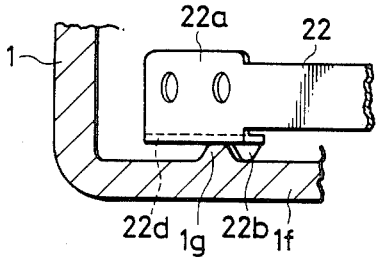
FIG. 12 is similar to FIG. 11 showing the stopper hook in a second position.

The stopper 21 comprises a stopper hook 22 made of a leaf spring, the stopper hook 22 having a perpendicular locking end 22*c* which is brought into and out of engagement with two engaging parts 19*a* formed on the rotor retaining plate 19. An operating lever 23 of the stopper 21 is secured to a base 22*a* of the stopper hook 22 and is rotatably supported by two bearing grooves 1*j* formed in the lower case 1. The operating lever 23 protrudes outside through a hole 24*a* formed in the upper case 74. The operating lever 23 has a cover 23*a* between its rotation axis and the upper case 24 so that the cover 23*a* closes the hole 24*a* no matter where the operating lever 23 is positioned. The side part 22*d* of the base 22*a* of the stopper hook 22, which is closed to the side wall 1*f* (FIG. 11) of the lower case 1, is bent along the side wall, and has a protrusion 22*b* at the end. As shown in FIGS. 11 and 12, a click stop protrusion 1*g* is formed on the side wall 1*f* of the side wall 1*f* so that the protrusion 22*b* rides over it. As the operating lever 23 is operated, the stopper piece 22 takes a stop position as shown in FIGS. 2 and 9, and a release position as shown in FIG. 10.

The lower case 1 has two holes 1*k* and three pins 1*m* which are engaged with corresponding pins (not shown) and holes 24*b* (only one is shown in FIG. 2) of the upper case 24. As shown in FIG. 2, the lower case 1 and the upper case 24 have a hole 1*n* and a through-hole 24*c* into which a regulator, namely, a dowel pin 25 is inserted in such a manner that it is located on the locus of rotation of the rotor 5.

A process of assembling the spring drive device thus constructed will now be described. First, one end of the output shaft 8 is inserted into the lower connector 3, and then the rotor 5, the spring holder 6 and the coil spring 9 are mounted on the shaft 8 in the stated order. Next, one end 10*a* of the coil spring 10 is engaged with the locking post 6*b*, while the other end 10*b* is engaged with the locking post 7*b* of the output gear 7. Under this condition, the output gear 7 is mounted on the shaft 8, in such a manner that the half-split cylinders 5*c* and 7*a* of the rotor 5 and the output gear 7 surround the coil spring 9. Next, the ratchet 11 is fitted onto the boss 7*e* of the output gear 7 with the bent protrusions 11*a* faced towards the recesses of the output gear. Then the upper connector 4 is put on the other end of the output shaft 8. Thereafter, the engaging protrusions 4*a* and 4*a* of the connector 4 are engaged with the cuts 11*b* of the ratchet 11.

The connectors 3 and 4, the rotor 5, the spring holder 6, the output gear 7 and the coil spring 10, which are mounted on the shaft 8, are biased by the central coil spring 9 along the shaft 8 so that they are moved away from one another. The connectors 3 and 4 are inserted into the bearing grooves 2 and 2 formed in the lower case 1 while being pushed against the elastic force of the central coil spring 9. In this operation, as the rotor 5 and the output gear 7 are moved away from each other by the elastic force of the coil spring 9, the flanges 3*b* and 4*b* of the connactors 3 and 4 are abutted against the inner wall of the lower case 1. A gap is formed between the inner end face of the boss 5*b* of the rotor 5 and the end face of the half-split cylinder 7*a* of the output gear 7, and a corresponding gap is formed between the inner end face of the boss 7*e* of the output gear 7 and the end face of the half-split cylinder 5*c* of the rotor 5. These gaps are used to relieve overload in the spring winding direction. The engaging part 6*a* of the spring holder 6 is engaged with the engaging hole 1*a* of the lower case, to hold the spring holder 6.

A procedure of assembling the speed governor will now be described. The assembly of the gears 13 and 14 is inserted in the lower case 1 before the aforementioned spring assembly. After the worm shaft assembly is inserted in the case, the shaft of the gears 15 and 16 is inserted into the bearing grooves 1*b*. Thereafter, the stopper 21 is engaged with the bearing grooves 1*j*.

As shown in FIG. 2, the operating lever 23 is extended through the hole 24*a*, and the upper tenon 18*b* of the worm shaft 18 is fitted in the tapered bearing hole 24*d*. Under this condition, the upper case 24 and the lower case 1 are joined together by press-fitting the pins into the holes.

Next, the operating lever 23 is set at the stop position as shown in FIG. 2. Under this condition, the connector 3 or 4 is turned in the direction of the arrow a, to wind the coil spring 10. The coil spring 10 can be wound either by the connector 3 or by the connector 4. However, by way of example the connector 4 will be used as a winder for bias charging in this embodiment.

Figure 8:
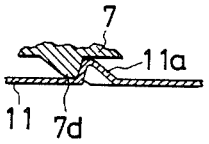
FIG. 8 is a sectional view taken along line VIII—VIII in FIG. 5.
Figure 5:
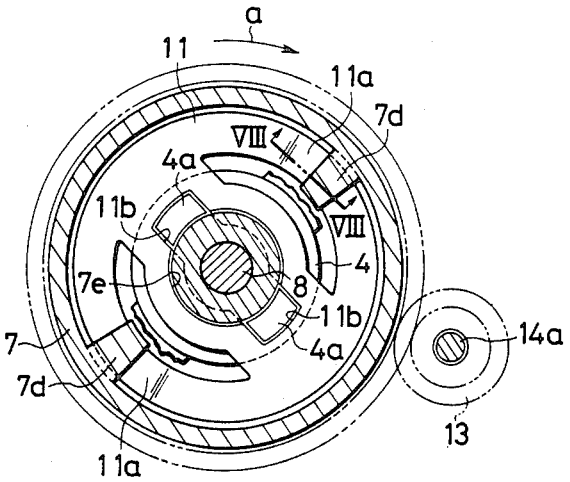
FIG. 5 is a sectional view taken along line V—V in FIG. 1.

In FIGS. 1 and 5, as the connector 4 is turned in the direction of the arrow a, the ratchet 11 engaged with the engaging protrusions 4*a* of the upper connector 4 is turned in the same direction, so that the bent protrusions 11*a* of the ratchet 11 engage with the engaging protrusions 7*d* of the output gear 7 (as shown in FIG. 8) to turn the output gear 7 in the same direction. As the output gear 7 is turned, the coil spring 10 secured to the spring holder 6 is wound. After the rotor 5 is retracted from the set position of the dowel pin 25 by about two revolutions of the output gear 7, the connector 4 is stopped. Under this condition, the dowel pin 25 is inserted into the through-hole 24*c* of the upper case 24 and the hole in of the lower case 1 from above. Thereafter, the connector 4 is released, so that the output gear 7, the ratchet 11 and the connector 4 are turned in the direction opposite to the direction of the arrow a by the charged energy of the coil spring 10. The rotation of the output gear 7 is transmitted through the half-split cylinders 7*a* and 5*c* to the rotor 5, so that the rotor 5 is turned in the direction opposite to the direction of the arrow a. The rotation of the rotor 5 is regulated by abutment of the engaging part 5 against the dowel pin 25 as shown in FIG. 2, so that the coil spring 10 remains charged. It goes without saying that the degree of the bias-charging of the coil spring 10 is suitably determined according to the characteristic of the spring so that the spring has a winding power as described later. The position where the rotor 5 abuts against the dowel pin 25 is the position where the coil spring starts its winding operation.

Now, the winding operation of the coil spring 10 will be described. At the start position, the rotor 5 is abutted against the dowel 25 as shown in FIG. 2, and the operating lever stops the speed governor with the stopper hook 22 engaged with the engaging part 19*a* of the retaining plate 19 (see FIG. 9). In this operation, the protrusion 22*b* of the stopper hook 22 is on the right side of the click stop protrusion 1*g* in FIG. 2 (on the left side in FIG. 11), to hold the operating lever 23 at the stop position. At the same time, the other end 10*b* of the coil spring 10 is positioned as shown in FIG. 4.

As was described above, the coil spring 10 can be wound either by the upper connector 3 or by the lower connector 4. However, the invention will now be described with reference to the case where the lower connector 3, rather than the upper connector 4, is employed during the winding. If, in FIGS. 1, 2 and 3, the connector 3 which is coupled, for instance, to the arm of a doll is turned in the direction of the arrow a, then the protrusion 3*a* is engaged with the engaging part 5*a* of the rotor 5, to turn the rotor 5 in the same direction. The rotation of the rotor 5 is transmitted through the engaged half-split cylinders 5*c* and 7*a* to the output gear 7, to turn the output gear 7 in the same direction. Therefore, the rotation of the output gear 7 turns the coil spring 10, both ends 10*a* and 10*b* of which are locked to the output gear 7 and the spring holder 6, respectively. As the output gear 7 is turned, the gear 13 engaged with the output gear 7 is turned. However, the rotation of the gear 13 is not transmitted to the speed increasing gear train because of the presence of the ratchet mechanism made up of the gears 13 and 14.

Figure 6:
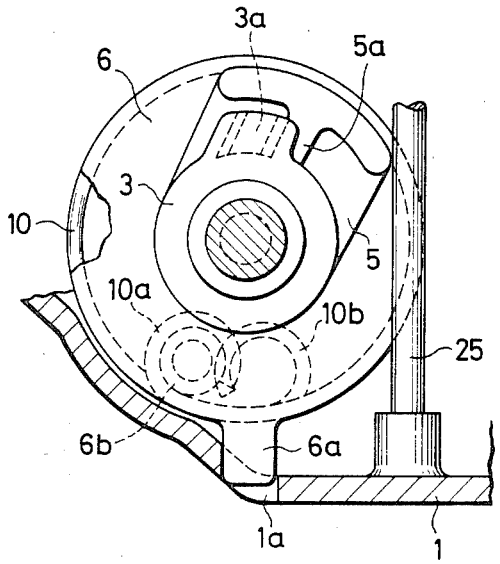
FIG. 6 is a front view of the lower case taken in the direction of the arrow VI in FIG. 1.

In the above-described embodiment, when the connector 3 is turned through about 220°, the rotor 5 abuts against the dowel pin 25, as shown in FIG. 6, to stop the rotation of the connector. In this operation, the coil spring 10 is charged with the other end 10*b* displaced as shown in FIG. 6. When the connector 3 is released after the coil spring 10 has been wound up, the output gear 7 tends to turn in the direction opposite to the direction of the arrow a (cf. FIG. 1). However, the output gear 7 cannot do so because the worm shaft 18 at the end of the speed increasing gear train is locked by the locking end 22*c* of the stopper hook 22.

The angle of rotation of the rotor 5 may be suitably determined according to the design of a device to be driven by the spring drive device of the invention, and it may be set to 360° or more by changing the width of the engaging part 5*a* of the rotor 5 in the direction of rotation or by making the pin 25 movable in a certain range.

Even if the connector 3 is further turned in the winding direction after the rotation of the rotor 5 is stopped by the pin 25, as the engaging part 5*a* of the rotor 5 is in inclined engagement with the protrusion 3*a* of the connector 3, the rotor 5 together with the spring holder 6 is pushed along the shaft 8 towards the output gear 7, thus disengaging from the protrusion 3*a*. Thus, the mechanism is protected from damage due to overload.

When the coil spring 10 is released, the spring drive device of the invention operates as follows. The operating lever 23 which has been set at the stop position as shown in FIGS. 2 and 9 is swung to the release position as shown in FIG. 10. As a result, the protrusion 22*b* of the stopper piece 22 rides over the click stop protrusion 1*g*, to click-stop the operating lever 23 at the release position as shown in FIGS. 10 and 12. When the operating lever 23 is held at the release position, the engaging end 22*c* of the stopper hook 22 is maintained spaced away from the engaging part 19*a* of the rotor receiving stand 19.

When the stopper hook 22 retracts as shown in FIG. 10, the speed increasing gear train (FIG. 1), consisting of the gears from the gear 13 to the worm shaft 18, is rotated at high speed by the output gear 7 which is turned by the charged energy of the coil spring 10. When the speed of the worm shaft 18 exceeds a certain value, as shown in FIG. 10, the braking rotor 20 is expanded outwards by the centrifugal force so that its peripheral edge is brought into contact with the wall le of the lower case. As a result, the rotation of its shaft is braked. As the rotor is repeatedly brought into slide contact with the wall, the output gear 7 is turned within a certain speed range.

As the output gear 7 is turned in the direction opposite to the direction of the arrow a, the engaging protrusions 7*d* are engaged with the bent protrusions 11*a* of the ratchet 11, so that the ratchet 11 and the connector 4 engaged with the ratchet 11 are turned in the same direction. On the other hand, the rotation of the output gear 7 is transmitted through the half-split cylinders 7*a* and 5*c* to the rotor 5, so that the connector 3 engaged with the rotor 5 is rotated in the same direction as the connector 4.

The rotation of the connectors 3 and 4 swings the arms of the doll (not shown). The arms of the dolls, coupled to the connectors 3 and 4, are stopped when the engaging part 5*a* of the rotor 5 engages with the stop pin 25.

In the above-described embodiment, the stop pin (dowel pin 25) for regulating the rotation of the rotor is the component which is formed separately from the case; however, the stop pin may be formed integrally with the case. In this case, before the assembly, formed by mounting the rotor, etc. on the shaft 8, is inserted in the case, the coil spring is charged in advance. In the above-described embodiment, in order to transmit the torque to the connector 4, the engaging protrusions 7*d* and 11*a* are arranged respective on diameters of the output gear 7 and the ratchet 11, as was described above. If the number of such engaging protrusions is increased, then the connectors 3 and 4 can be together operated more effectively. Furthermore in the above-described embodiment, the charged energy of the coil spring is applied to both of the connectors. However, it goes without saying that it can be applied to only one of the connectors.

Figure 13:
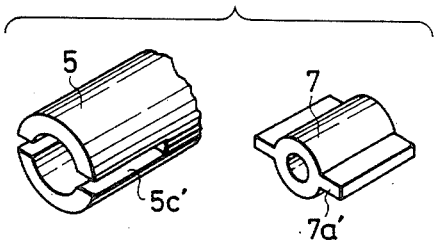
FIG. 13 is a perspective view showing one modification of the spring drive device according to the invention.

In the above-described embodiment, the rotor 5 is engaged with the output gear 7 through the half-split cylinders 5*c* and 7*a*. However, they may be so modified that, as shown in FIG. 13, the output gear 7 has protrusions 7*a'* which are engaged with grooves 5*c'* formed in the rotor 5, or they may be combined together through spline gears so that they are engaged with each other in the direction of rotation and are slidable in the axial direction. Furthermore, if the engaging protrusions 7*d* are formed in the recess of the output gear 7 which is on the side of the connector 4 so that they can engaged with the engaging protrusions 4*a* of the connector 4, then the ratchet 11 can be eliminated. In addition, if the engaging hole 1*a* of the lower case 1 is made larger, then the engaging part 6*a* of the spring holder 6 can be more readily inserted into the hole 1*a*.

As is apparent from the above description, in the spring drive device according to the invention the range of rotation is regulated with a simple structure. Therefore, the spring drive device of the invention can efficiently and uniformly utilize the charged energy of the coil spring. Furthermore, the device is small in size and can be assembled readily.

We claim:

1. A spring device comprising:

a motive spring including a coil spring;

winding means for winding said motive spring;

a rotary shaft;

a spring holder to which one end of said coil spring is secured said spring holder being mounted on said shaft;

an output gear which is mounted on said shaft, and to which the other end of said coil spring is secured so that said output gear is turned by said coil spring;

a rotor mounted on said shaft;

means for coupling said rotor to said output gear in the direction of rotation;

regulating means for limiting the angle of rotation of said rotor; and a case enclosing said spring holder, output gear and rotor, said spring holder having a part engaged with said case.

2. A spring drive device as claimed in claim 1, further comprising speed governor means to which said output gear is coupled.

3. A spring drive device as claimed in claim 2, further comprising a stopper which is brought into and out of engagement with said speed governor means.

4. A spring drive device as claimed in claim 1, further comprising ratchet means between said winding means and said output gear and between said winding means and said rotor.

5. A spring drive device as claimed in claim 1, in which said regulating means is a shaft which is press-fitted into said case from outside.

6. A spring drive device as claimed in claim 1, in which a protrusion of said spring holder is engaged with a hole formed in said case.

7. A spring drive device as claimed in claim 1, in which said stationary member comprises a generally disk-like portion in which said part engaged with said case comprises a tab extending from a periphery of said disk-like portion.

8. A spring drive device as claimed in claim 7, in which said stationary member further comprises a locking post extending from said disk-like portion, said one end of said coil spring being secured to said locking post.

9. A spring drive device as claimed in claim 8, in which said stationary member further comprises at least one guide piece extending from said disk-like portion for preventing unwanted deformation of said spring once said spring is energized.

* * * * *